US007070520B1

(12) United States Patent
An

(10) Patent No.: US 7,070,520 B1
(45) Date of Patent: Jul. 4, 2006

(54) SPORTS TRAINING DEVICE FOR HITTING A BALL

(76) Inventor: Benjamin J. An, 2520 Bunker Hill, Ann Arbor, MI (US) 48105

( * ) Notice: Subject to any disclaimer, the term of this patent is extended or adjusted under 35 U.S.C. 154(b) by 15 days.

(21) Appl. No.: 10/955,348

(22) Filed: Sep. 30, 2004

(51) Int. Cl.
*A63B 69/00* (2006.01)

(52) U.S. Cl. ..... 473/422; 473/139; 473/149; 473/451; 473/459

(58) Field of Classification Search ..... 473/139, 473/147, 149, 422, 423, 451, 459
See application file for complete search history.

(56) References Cited

U.S. PATENT DOCUMENTS 519,918 A * 5/1894 MacLearn ..... 482/90
925,342 A * 6/1909 Johnson ..... 482/90
2,510,266 A * 6/1950 Taylor ..... 473/149
4,417,730 A * 11/1983 Weiner ..... 473/426
4,681,318 A * 7/1987 Lay ..... 473/423
4,830,371 A * 5/1989 Lay ..... 473/423
4,938,478 A * 7/1990 Lay ..... 473/423
5,100,134 A * 3/1992 Becker ..... 473/417
6,616,554 B1 * 9/2003 Liao ..... 473/417

* cited by examiner

*Primary Examiner*—Raleigh W. Chiu
(74) *Attorney, Agent, or Firm*—James M. Deimen

(57) ABSTRACT

A sports training device comprises a substantially vertical standard with a suitable ball at the top for practicing sports such as baseball or tennis or a bent over standard with a ball close to the ground for practicing sports such as golf. The ball is attached to an arm that is, in turn, attached to a pivot and a spring both on the standard. Striking the ball in the normal manner for the particular sport causes the ball to move away from the bat, racket or club until clear. The ball then returns under the influence of the spring and oscillates about the starting location of the ball. Depending on spring tension and damping effects of the arm, spring and standard, the ball will become stationary very quickly or continue to oscillate widely. For some sports, heavy damping is preferred. For other sports, light damping may be preferred.

9 Claims, 2 Drawing Sheets

SPORTS TRAINING DEVICE FOR HITTING A BALL

BACKGROUND OF THE INVENTION

The field of the invention pertains to sports such as golf, tennis, baseball, and other sports where a ball is struck with a club, racket, bat, paddle or similar device.

Participation in such sports requires considerable practice to attain a performance level that results in a sense of accomplishment and skill. Reasonable skill at any of these sports is required for personal enjoyment of the sport. Playing most of these sports requires a large, specially prepared course or field, and even practice fields limited to hitting the ball tend to be much larger than can be accommodated at a typical home.

Pitching machines for baseball and tennis have become common but are generally too expensive and require too much space for home use. Moreover, as with practice fields, the balls are not conveniently and automatically returned to the user. With a view to providing a device that positions a ball for hitting and that returns the ball to hitting position, the following devices have been developed by the applicant.

SUMMARY OF THE INVENTION

The new sports training devices comprise a substantially vertical standard with a suitable ball at the top for practicing sports such as baseball or tennis or a bent over standard with a ball close to the ground for practicing sports such as golf. The ball is attached to an arm that is, in turn, attached to a pivot and a spring both on the standard. Striking the ball in the normal manner for the particular sport causes the ball to move away from the bat, racket or club until clear. The ball then returns under the influence of the spring and oscillates about the starting location of the ball. Depending on spring tension and damping effects of the arm, spring and standard, the ball will become stationary very quickly or continue to oscillate widely. For some sports such as golf, heavy damping is preferred. For other sports, light damping may be preferred.

DESCRIPTION OF THE PREFERRED EMBODIMENT

Figure 1:
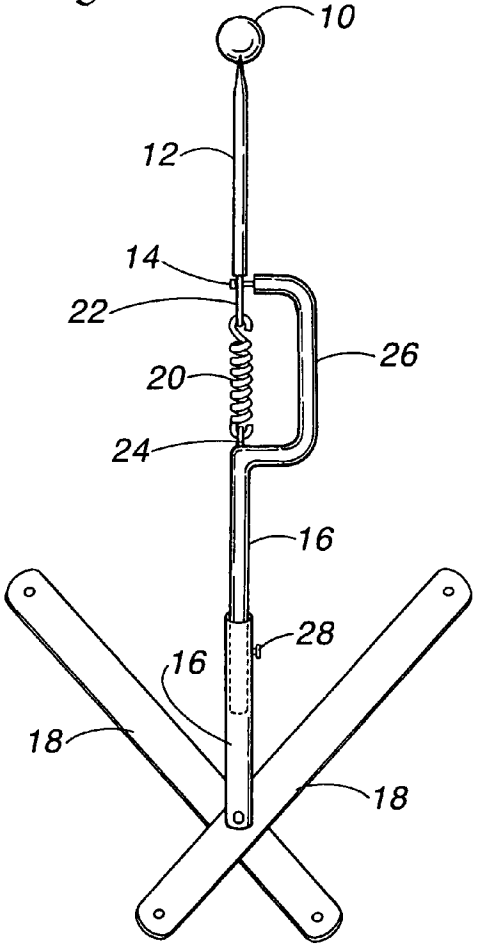
FIG. 1 is a perspective view of the device with a ball at the top.

Illustrated in FIG. 1 is the device with the ball 10 at the top. The ball 10 is attached to the arm 12, and the arm is pivotably attached to a pivot 14 at a location on the arm spaced from the ball. The pivot 14 is attached to a generally vertical standard 16, and the lower most end of the standard is attached to a base 18. The base 18 is shown as a pair of lengthy pieces of metal or wood. Alternate bases might be employed, such as a heavy weight or a pointed shaft thrust into the ground.

A spring 20 is attached to the end 22 of the arm 12 remote from the ball 10, and the other end of the spring is attached to the standard at 24. Between the pivot 14 and the attachment at 24, the standard 16 is shaped as a spring housing 26 to provide clearance for the spring 20. The standard 16 is also optionally provided with a vertical height adjustment, as shown at 28.

Figure 2:
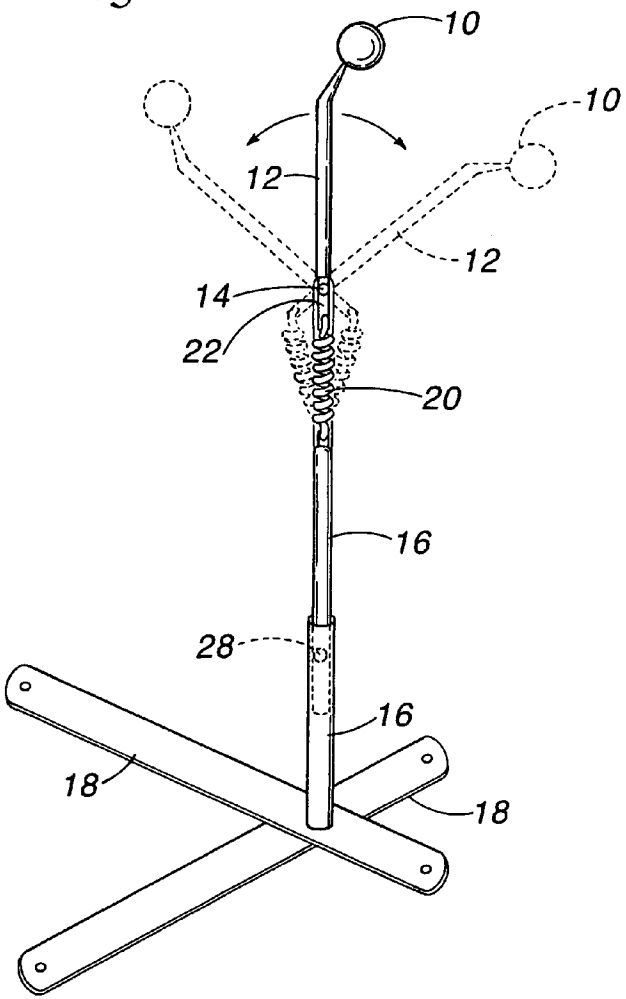
FIG. 2 illustrates the device in oscillation mode.

In FIG. 2, the arm 12, ball 10, and spring 20 are shown oscillating back and forth about the pivot 14 after the ball has been struck. The spring 20 extends and contracts to provide the oscillating action, and thereby a moving target, for subsequent swings of a bat or racquet. Where a moving target is not desired, the pivot 14 may be provided with sufficient spring or frictional damping to bring the oscillation quickly to a halt. Although shown as oscillation in a plane about pivot 14, substitution of a ball and socket joint for the pivot 14 will provide oscillation in three dimensions for a more random movement of the ball 10.

Figure 5:
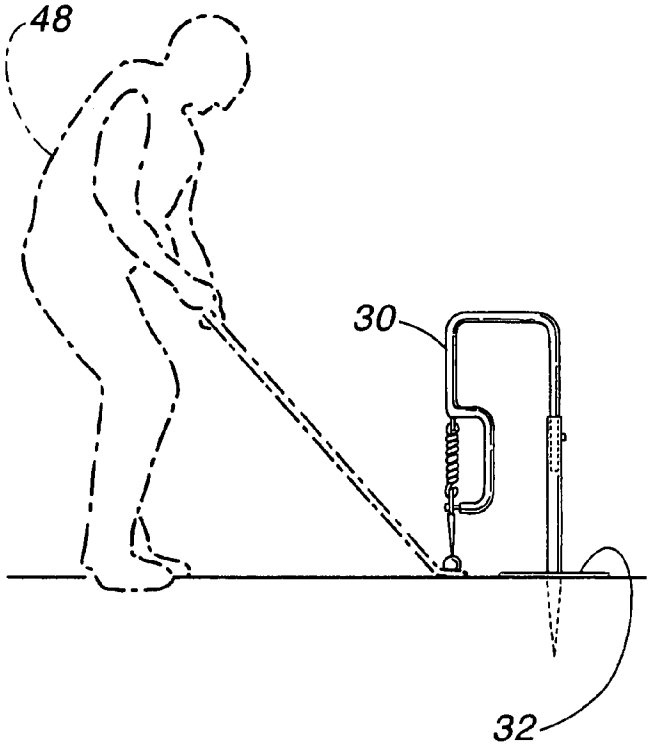
FIG. 5 illustrates use of the bent over device for golf practice.
Figure 4:
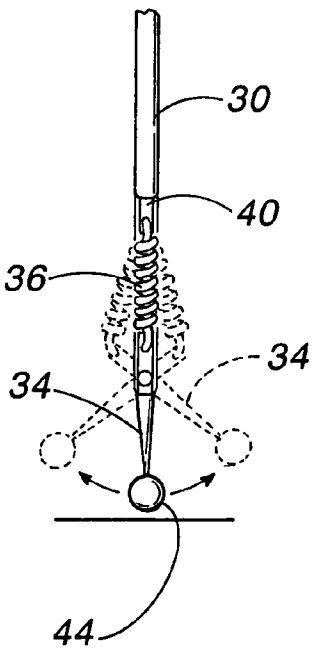
FIG. 4 is a front view of the bent over form of the device.
Figure 3:
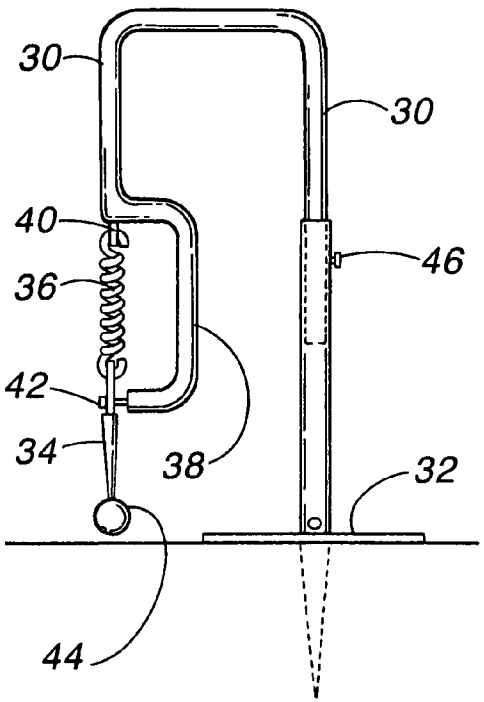
FIG. 3 is a side view of the bent over form of the device.

Illustrated in FIGS. 3, 4 and 5 is the bent over standard 30 supported on abase 32 as disclosed above. The arm 34, spring 36, spring housing 38, spring attachment 40 and pivot 42 are substantially similar to FIG. 1 but upside down and supporting a golf ball 44. In this embodiment, substantial damping is preferred since a golf ball is struck only when stationary. By properly adjusting the standard 30 with the height adjustment 46, the golfball 44 can be positioned at a proper "Tee" height for the player 48.

The invention claimed is:

1. A sports training device comprising a vertical standard, a pivot on the standard, an arm pivotably mounted on the pivot, a ball mounted on one end of the arm and a spring attached to the arm, the spring being attached to the standard, wherein the vertical standard includes a spring housing to provide clearance for the spring, and whereby striking the ball sharply causes the arm to rotate about the pivot and the return force applied by the spring causes the arm and ball to oscillate about the pivot.

2. The sports training device of claim 1 including means at the bottom of the vertical standard to retain the standard vertical regardless of impact on the ball.

3. The sports training device of claim 1 including means on the standard to adjust the height of the standard.

4. A sports training device comprising a vertical standard, a pivot on the standard, an arm pivotably mounted on the pivot, a ball mounted on one end of the arm and a spring attached to the arm, the spring being attached to the standard, wherein the vertical standard is bent over, suspending the ball just above the ground, and whereby striking the ball sharly causes the arm to rotate about the pivot and the return force applied by the spring causes the arm and ball to oscillate about the pivot.

5. The sports training device of claim 4, including means at the bottom of the vertical standard to retain the standard vertical regardless of impact on the ball.

6. The sports training device of claim 4 including means on the standard to adjust the height of the standard.

7. A sports training device comprising a vertical standard, a pivot on the standard, an arm pivotably mounted on the pivot, a ball mounted on one end of the arm and a spring attached to the arm, the spring being attached to the standard, wherein the spring oscillates in a direction opposite the oscillation of the ball, and whereby striking the ball sharply causes the arm to rotate about the pivot and the return force applied by the spring causes the arm and ball to oscillate about the pivot.

8. The sports training device of claim 7 including means at the bottom of the vertical standard to retain the standard vertical regardless of impact on the ball.

9. The sports training device of claim 7 including means on the standard to adjust the height of the standard.

* * * * *